US008397782B2

(12) United States Patent
Kulpa et al.

(10) Patent No.: US 8,397,782 B2
(45) Date of Patent: Mar. 19, 2013

(54) MAILING MACHINE FLUID LEVEL INDICATOR

(75) Inventors: Walter J. Kulpa, Trumbull, CT (US); Daniel R. Salomone, Milford, CT (US); Jay Reichelsheimer, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 392 days.

(21) Appl. No.: 12/643,791

(22) Filed: Dec. 21, 2009

(65) Prior Publication Data

US 2011/0079359 A1 Apr. 7, 2011

Related U.S. Application Data

(60) Provisional application No. 61/247,794, filed on Oct. 1, 2009.

(51) Int. Cl.
*B43M 5/04* (2006.01)
*B65B 43/39* (2006.01)

(52) U.S. Cl. ..... 156/441.5; 222/51

(58) Field of Classification Search ..... 156/441.5; 222/51

See application file for complete search history.

(56) References Cited

U.S. PATENT DOCUMENTS

| | | | | | |
|---|---|---|---|---|---|
| 4,570,823 | A * | 2/1986 | Arabian et al. | ..... | 222/28 |
| 4,752,019 | A * | 6/1988 | Walker | ..... | 222/51 |
| 4,935,078 | A * | 6/1990 | Bergman et al. | ..... | 156/64 |
| 5,242,499 | A * | 9/1993 | Bergman | ..... | 118/669 |
| 5,674,348 | A * | 10/1997 | DeFiguerido | ..... | 156/441.5 |
| 5,807,463 | A * | 9/1998 | Boughton | ..... | 156/441.5 |
| 6,089,086 | A * | 7/2000 | Swindler et al. | ..... | 73/317 |
| 6,094,894 | A * | 8/2000 | Yates | ..... | 53/505 |
| 6,708,467 | B2 * | 3/2004 | Antonelli et al. | ..... | 53/479 |

* cited by examiner

*Primary Examiner* — Mark A Osele

(74) *Attorney, Agent, or Firm* — George M. Macdonald; Charles R. Malandra, Jr.; Steven J. Shapiro

(57) ABSTRACT

An illustrative mailing machine is provided including a moistening fluid level indicator. The mailing machine includes a mail piece transport including a mail piece flap opening and moistening assembly, a moistening fluid container operatively connected to the moistening assembly for providing moistening fluid to the moistening assembly, and a fluid level indicator arm operatively connected to the moistening fluid container, wherein the fluid level indicator arm has an indicator surface adjacent to an indicator window for indicating the presence of the moistening fluid level container and for indicating an amount of moistening fluid in the container.

10 Claims, 6 Drawing Sheets

MAILING MACHINE FLUID LEVEL INDICATOR

CROSS REFERENCE TO RELATED APPLICATIONS

This application claims priority under 35 U.S.C. section 119(e) from Provisional Patent Application Ser. No. 61/247,794, filed Oct. 1, 2009, entitled Mailing Machine Fluid Level Indicator, by Walter J. Kulpa, et al., which is incorporated herein by reference in its entirety.

TECHNICAL FIELD

The illustrative embodiments of the present invention relate generally to mailing machine fluid level indicators and, more particularly, to new and useful systems providing an effective level indicator for gravity-fed fluid delivery subsystems.

BACKGROUND

Certain mailing machines including certain DM SERIES mailing machines available from Pitney Bowes Inc. of Stamford, Conn. include an envelope flap sealing subsystem. The envelope flap sealing subsystem includes a gravity-fed fluid delivery subsystem that feeds an appropriate moistening fluid to a wick and then brush that moistens an envelope flap as the envelope is fed past the flap sealing subsystem.

The fluid delivery subsystem includes a moistening fluid storage bottle that holds a supply of moistening liquid that is gravity-fed in a "chicken-feeder" fashion to the wick and brush combination that applies the moistening fluid to the flap of an envelope. The moistening fluid storage bottle has a cap that incorporates a spring-loaded plunger to seal it from leaking when the bottle is in the cap-down orientation needed to install or withdraw it from the moistener. There is a post-like feature in the moistener that pushes the spring loaded plunger to the open position as the bottle completes its engagement in the moistener fluid tray. Since the spring force on the plunger is higher than the weight of the empty bottle, it will cause the bottle to rise vertically was it nears being empty. In such a system the operator will not know when it is advisable to replace the moistening fluid bottle. If an operator wishes to start a large envelope batch job, it may be necessary to know if a suitable amount of moistening fluid is available before starting the batch job.

Certain prior mailing machines including envelope moistening subsystems included either a sight glass in the wick tank or a float that activated an optical sensor. Both prior systems only indicate when there is no liquid remaining in the bottle and are not as useful for providing a preventive maintenance indication that an almost empty bottle should be changed to accommodate a large batch mail run. Moreover, they may not indicate a missing fluid container.

Accordingly, there is a need for an inexpensive mechanism for indicating moistener fluid level status or to indicate a missing fluid container. Optical detectors are sometimes used to detect fluid levels, but they require wiring in close proximity to the moistening liquid that could damage the detector and/or the printed circuit board that is driving it. Certain optical detectors require floats that can stick to walls due to the surface tension of the moistening liquid or containers having transparent walls that may get dirty over time. This illustrative embodiments of the present application fulfill at least the need for indicating to the operator that the moistener liquid level is getting low, when it is depleted and/or an indication of the number of envelopes that may be moistened.

BRIEF DESCRIPTION OF THE DRAWINGS

The accompanying drawings show illustrative embodiments of the invention and, together with the general description given above and the detailed description given below serve to explain certain principles of the invention. As shown throughout the drawings, like reference numerals designate like or corresponding parts.

SUMMARY

Figure 1:
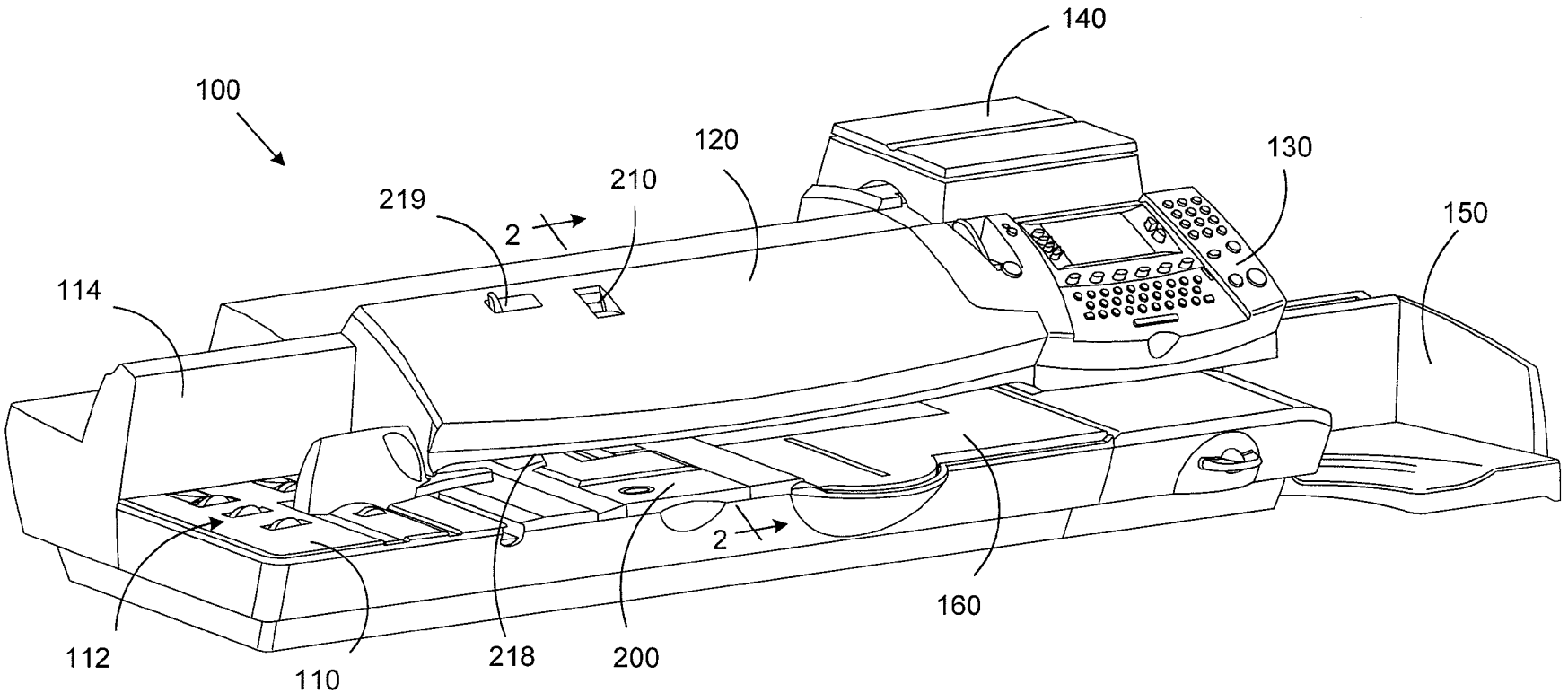
FIG. 1 is a top-front-left perspective view of a mailing machine according to an illustrative embodiment of the present application.

An illustrative mailing machine is provided including a moistening fluid level indicator. The mailing machine includes a mail piece transport including a mail piece flap opening and moistening assembly, a moistening fluid container operatively connected to the moistening assembly for providing moistening fluid to the moistening assembly, and a fluid level indicator arm operatively connected to the moistening fluid container, wherein the fluid level indicator arm has an indicator surface adjacent to an indicator window for indicating the presence of the moistening fluid level container and for indicating an amount of moistening fluid in the container.

In an alternative illustrative embodiment, a mailing machine is provided including an electrical moistening fluid detector. The mailing machine includes a mail piece transport including a mail piece flap opening and moistening assembly, a moistening fluid container operatively connected to the moistening assembly for providing moistening fluid to the moistening assembly, and an electrical moistening fluid detector downstream of the moistening fluid applicator for detecting presence of moistening fluid.

DETAILED DESCRIPTION

The illustrative embodiments of the present application provide new and useful mailing machine fluid level indicators and, in certain embodiments, effective level indicators for gravity-fed fluid delivery subsystems. The illustrative embodiments described herein satisfy at least a need for an inexpensive means of indicating moistener liquid status such as for indicating to the mailing machine operator that the moistening fluid container is missing, that moistener liquid level is getting low, when it is depleted and/or indicating the number of envelopes that may be moistened.

The illustrative embodiments provide a fluid level indicator including a lever mechanism that contacts the top of a moistener bottle and moves a colored surface past an opening in a machine cover to indicate at least four states. The first state indicates that the bottle is not installed. Conversely, any fluid level indication will also indicate that the bottle is in place. The second state is that the bottle contains a relatively large amount of liquid. The third state is that the bottle is transitioning from full toward empty. The fourth state is that the bottle is empty. An additional feature includes providing a hash line indicating that enough moistening fluid for a number of envelopes remains, e.g. 100 envelopes. The hash line may be adjustable to indicate a different number of envelope moistening capacity or may be replaced by a number providing such indication.

Certain illustrative embodiments of the present application provide a pivoting lever with unequal lever lengths in contact with the top of the moistening fluid bottle. The end of the shorter lever length is in contact with the top of the bottle and the longer length contains an arc-shaped surface with at least two different colors. The arc-shaped surface is in close proximity to the inside of the machine jam access cover and the jam access cover has an indicator opening that allows the color of the arc-shaped surface to be viewed. In an alternative embodiment, the arc shaped surface includes a hash mark used to indicate the number of envelopes that may be processed with the then current fluid level. A corresponding scale may be printed on the jam access cover adjacent to the indicator opening.

When the moistener bottle is full, its weight fully compresses the spring in its cap and the lever resting on the bottle positions the arc-shaped surface of the lever to a location that displays a first color such as blue in the opening in the jam clearing cover. As the moistener bottle nears being empty, the spring in its cap causes it to rise and move the arc-shaped surface on the lever to a position where the color line between its blue area and its red area appear in the opening in the jam clearing cover. Ultimately, that line moves downward in the cover opening as the bottle becomes completely empty. There is a second indicating area on the arch-shaped surface on the lever that is on the opposite extreme of the stroke of the lever. It appears in the opening in the cover when the bottle is not in the machine. Previous indicators would indicate only one or two of the states of the moistening liquid. The illustrative embodiments described herein indicate at least three distinct states. Moreover, the fluid level indicators described provide at least an analog estimate reading such as some degree of a "fuel gauge" like indication. For example, in the three color embodiment, the line between the blue and the red area is visible through the opening in the cover and moves as fluid is used. Additionally, more specific envelope capacity numbers may be provided as a preventive maintenance indicator to facilitate large mail batch runs.

Referring to FIG. 1, a top-front-left perspective view of a mailing machine 100 according to an illustrative embodiment of the present application is shown. Mailing machine 100 includes a deck 110 on its base that includes the feeding and other mechanisms. An envelope or other mail piece is loaded at the input side of the transport feed deck 112. The mailing machine 100 also includes a registration wall 114. The envelope proceeds along the deck generally in a left to right direction from the input side of the feed deck 112 eventually to the output bin/stacker 150. The envelope passes through an envelope flap sealing station 200 and then proceeds though weighing section 160 under the franking print station and then to the output bin 150. The mailing machine 100 includes a user interface 130 having a keypad and display. The mailing machine user interface 130 also includes at least one controller such as an SH3 processor and associated support circuitry and memory. The media path jam clearing cover 120 (the "top cover") may be opened to reveal the moistening fluid container bottle and other components (not shown). An indicator window 210 is displaced in the jam clearing cover 120 to provide a viewing port for the moistening fluid level indicator assembly. The transport system is under control of a transport processor such as an SH3 processor and associated support circuitry and memory. Alternatively, a single processor is used to control the transport, user interface and other control functions. The mailing machine 100 also includes a postal security device that is a secure coprocessor used for storing and accounting for postal funds dispensed by the postage meter in the mailing machine 100.

In this illustrative embodiment, the mailing machine 100 includes a manual sealing function engagement lever 219. When the sealing lever 219 is placed in the engaged position, the sealing ramp 218 is lowered below the mailing machine transport deck 112. The envelope flaps are partially opened to separate the flap 11 from the envelope 10 body sufficiently to transport the glue of the flap against the moistened sealing brush such that the envelope flaps are moistened. In certain mailing machines, the sealing ramp is automatically lowered via solenoid action controlled by the user interface controller. In the manual sealing function engagement lever 219 configuration, an electrical switch and/or optical sensor may be used to determine and report to the controller when the lever 219 is placed in the engaged position to indicate that the mailing machine 100 is set to moisten envelopes 10.

Figure 2:
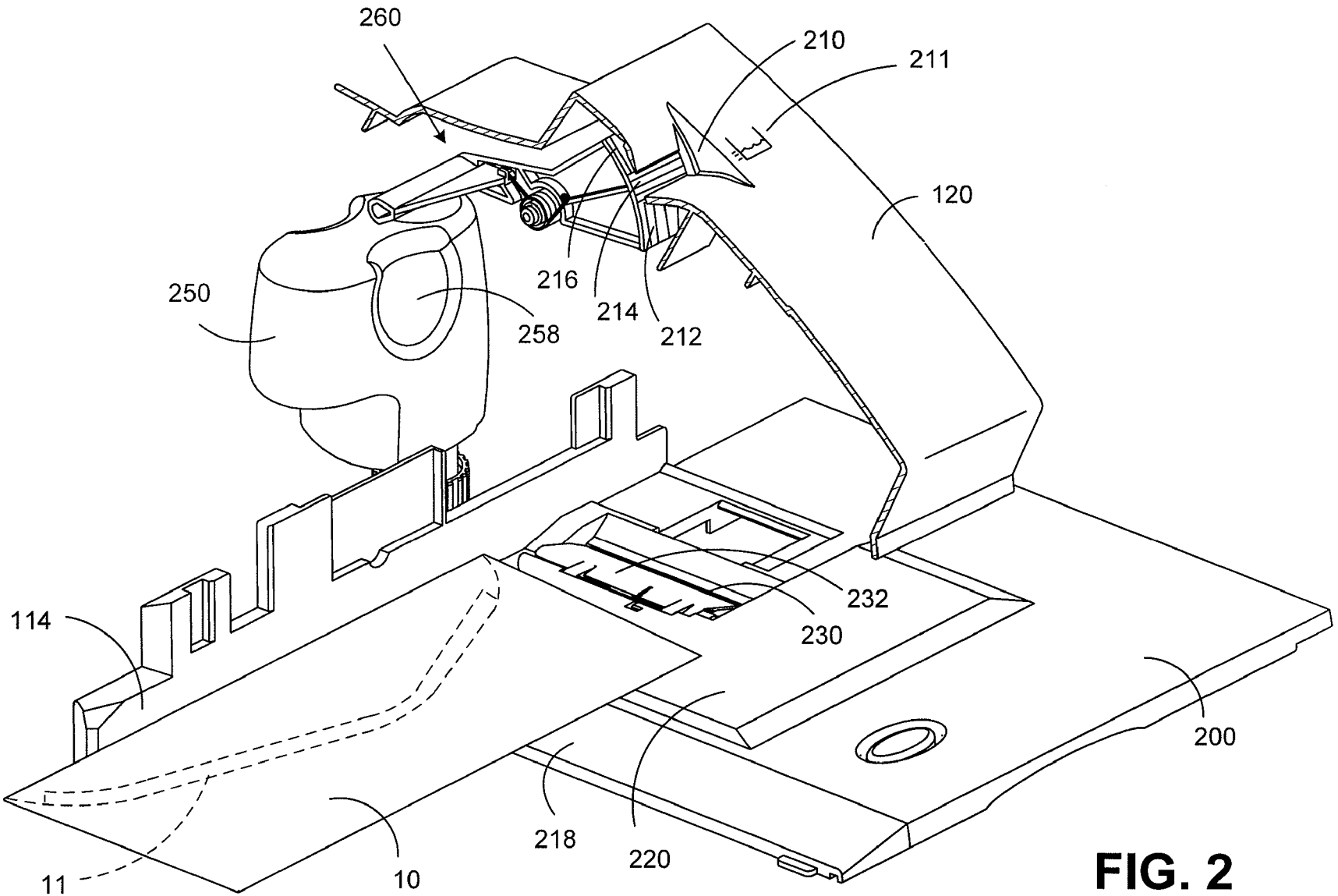
FIG. 2 is a partial cutaway view along line 2-2 of FIG. 1.

Referring to FIG. 2 is a partial cutaway view along line 2-2 of FIG. 1 to illustrate the operation of the flap opening and moistening brush assembly 200. The assembly 200 includes an opener deck 220 and associated brush holder 232 and moistening brush 230. Moistening fluid container bottle 250 includes a finger grip 258 and is also operatively connected to fluid level indicator assembly 260. The top cover 120 includes an indicator window 210. The envelope 10 with flap 11 is transported adjacent to registration wall 114 along the feed deck 110 generally in a left to right direction. As the envelope passes thorough the assembly 200, it is opened and the flap is moistened. If the mail batch run does not need to be sealed, the seal/no seal lever 219 located near the indicator window 120 is activated to raise a bypass ramp in the assembly 200 so that the opening blade/ramp 218 is not engaged.

When the moistener bottle 250 is full, its weight fully compresses the spring in its cap 252 and the lever 260 resting on the bottle positions the arc-shaped surface of the lever to a location that displays a first color 212 such as blue in the opening in the jam clearing cover. As the moistener bottle 250 nears being empty, the spring in its cap 252 causes it to rise and move the arc-shaped surface on the lever 260 to a position where the color line between its blue area 212 and its red area 214 appear in the opening in the jam clearing cover. Ultimately, that line moves downward in the cover opening as the bottle becomes completely empty. There is a second indicating area 216 on the arch-shaped surface on the lever that is on the opposite extreme of the stroke of the lever. It appears in the opening in the cover when the bottle is not in the machine and may be a white color. Previous indicators would indicate only one or two of the states of the moistening liquid. The illustrative embodiments described herein indicate at least three distinct states. Moreover, the fluid level indicators described provide at least an analog estimate reading such as some degree of a "fuel gauge" like indication using a scale 211 marked on cover 120. For example, in the three color embodiment, the line between the blue and the red area is visible through the opening 210 in the cover 120 and moves as fluid is used and can provide a level indication using scale 211.

Figure 3A:
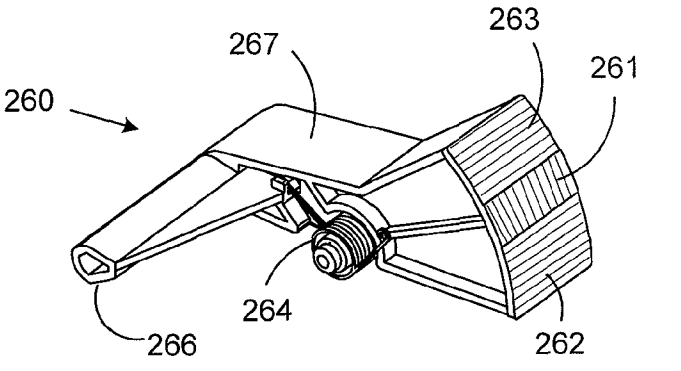
FIG. 3A is a perspective view of a fluid level indicator assembly according to an illustrative embodiment of the present application.
Figure 3:
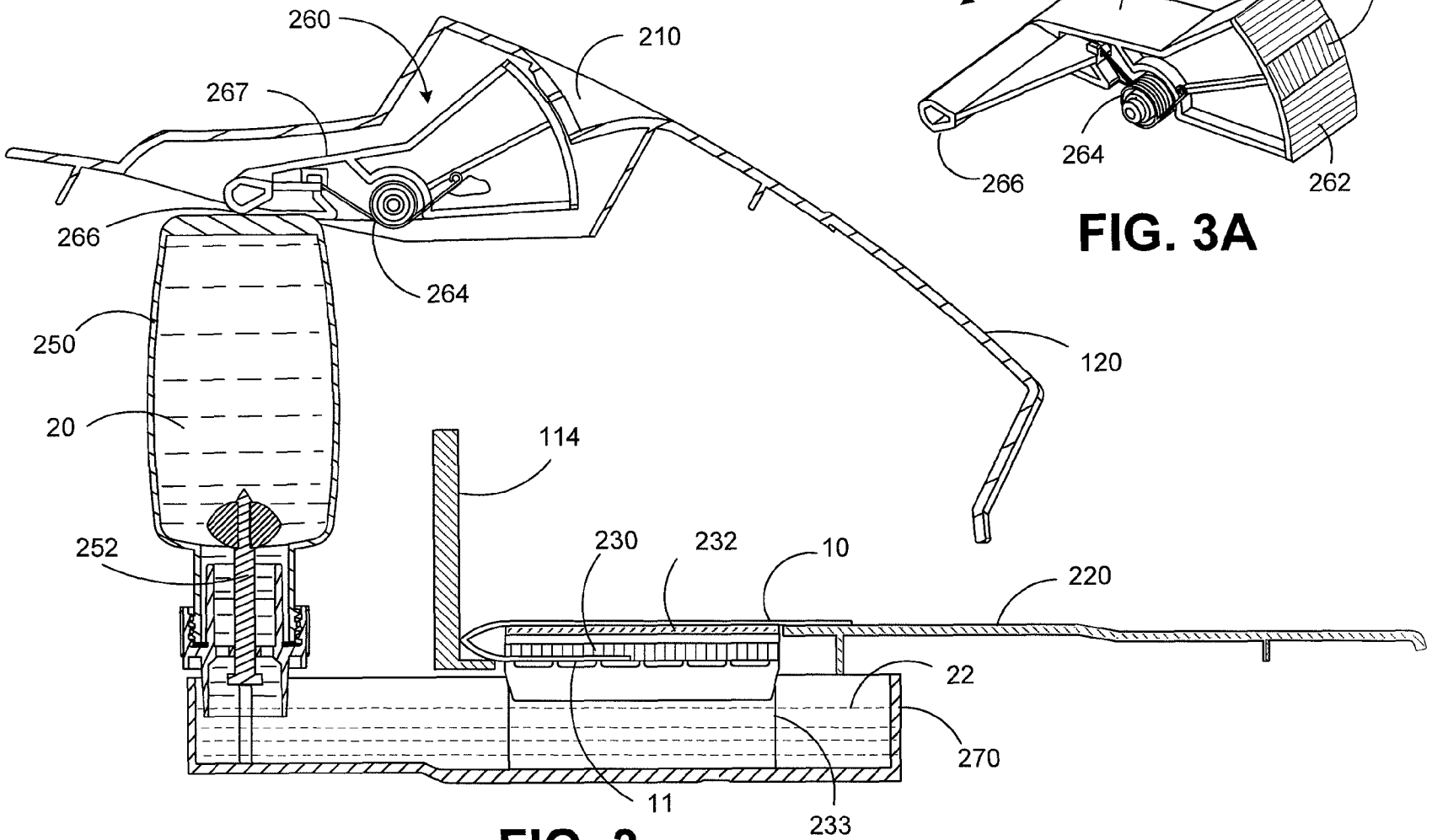
FIG. 3 is a partial sectional view along line 2-2 of the mailing machine of FIG. 1 having a full moistening fluid container.

Referring to FIG. 3, a partial sectional view along line 2-2 of the mailing machine of FIG. 1 having a full moistening fluid container 250 is shown. The top cover 120 and indicator window 210 are shown in relation to the fluid level indicator assembly 260. The arm 267 is biased using spring 264 and includes cam surface 266 that engages the bottle 250. Moistening fluid container 250 is a bottle that contains not yet dispensed moistening fluid 20. The bottle 250 includes a spring loaded valve mechanism and cap 252 used to engage a plunger in the moistening fluid tray 270 that contains the dispensed fluid 22. The envelope 10 and flap 11 engage the moistening subassembly blade 220 while being transported adjacent to the registration wall 114. The dispensed fluid 22 engages moistening fluid wick 233 that feeds moistening brush bristles 230 to moisten flap 11. Even after bottle 250 is just emptied, the fluid tray 270 will contain a significant amount of dispensed fluid 22 that may be used to indicate an amount of envelope moistening capacity when the bottle empty condition is reached.

Referring to FIG. 3A, a perspective view of a fluid level indicator assembly 260 according to an illustrative embodiment of the present application is shown. The assembly 260 includes an arm 267 having a cam surface 266 and is biased by spring 264. The indicator surface 261, 262, 263 indicate the moistening fluid container state. In one embodiment, 262 and 263 are red in color. When area 263 is showing through the indicator window 210, the bottle 250 is empty. When red indicator 262 is showing though the indicator window 210, the bottle 250 is missing. The amount of blue indicator 261 visible in window 210 will provide an indication of the amount of fluid 20 remaining in the bottle 250. Here, three colors may be used with the no bottle present indicator 262 marked a different color such as yellow. Additionally or alternatively, in another embodiment a hash indicator may be used to mark an envelope capacity. In yet another embodiment, symbols may be placed on the indicator face or multiple hash marks or a scale.

Figure 4A:
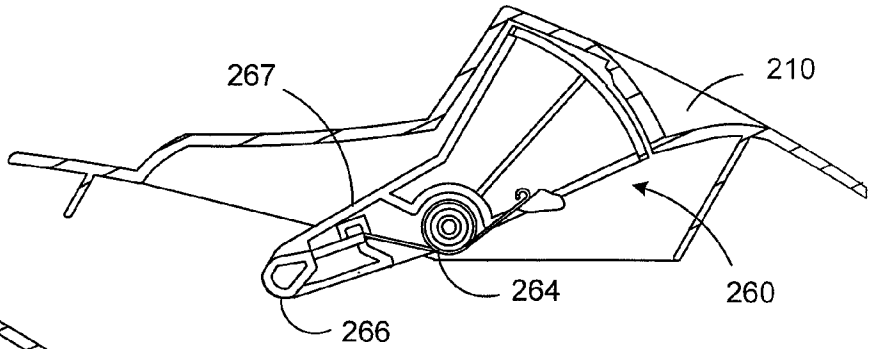
FIG. 4A is a partial side cutaway view of the indicator assembly and mailing machine cover of FIG. 1 having a missing moistening fluid container.
Figure 4:
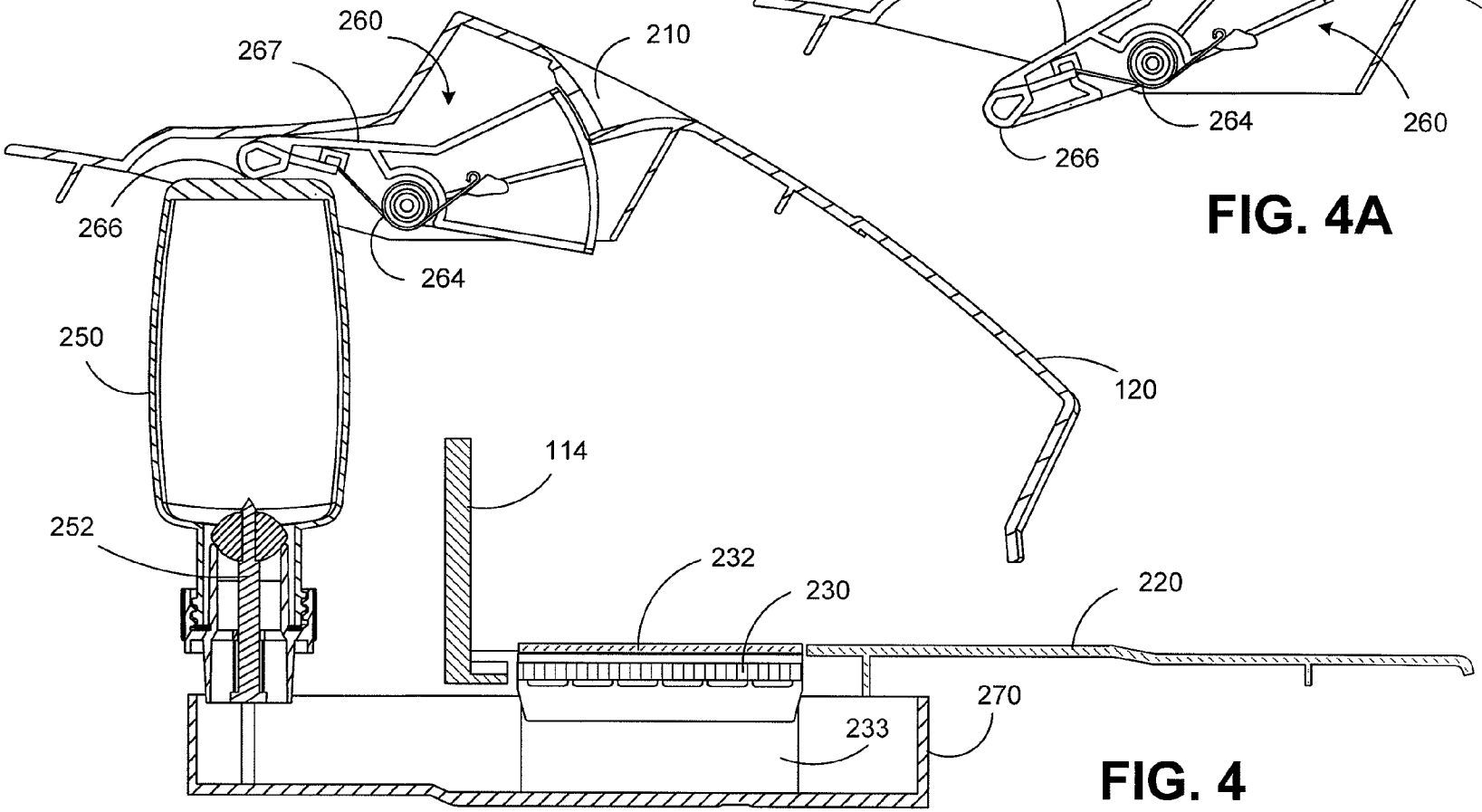
FIG. 4 is a partial sectional view along line 2-2 of the mailing machine of FIG. 1 having an empty moistening fluid container.

Referring to FIG. 4, a partial sectional view along line 2-2 of the mailing machine of FIG. 1 having an empty moistening fluid container 250 is shown. The top cover 120 and indicator window 210 are shown in relation to the fluid level indicator assembly 260. The arm 267 is biased using spring 264 and includes cam surface 266 that engages the bottle 250. Moistening fluid container 250 is a bottle that contains no moistening fluid. The bottle 250 includes a spring loaded valve mechanism and cap 252 used to engage a plunger in the moistening fluid tray 270 that typically contains the dispensed moistening fluid. The envelope and flap would then engage the moistening subassembly blade 220 while being transported adjacent to the registration wall 114. The dispensed fluid 22 engages moistening fluid wick 233 that feeds moistening brush bristles 230 to moisten flap 11. Even after bottle 250 is just emptied, the fluid tray 270 will contain a significant amount of dispensed fluid 22 that may be used to indicate an amount of envelope moistening capacity when the bottle empty condition is reached.

Referring to FIG. 4A, a partial side cutaway view of the indicator assembly 260 and mailing machine cover 120 of FIG. 1 having a missing moistening fluid container is shown. The assembly 260 includes an arm 267 having a cam surface 266 and is biased by spring 264. The indicator surface (not visible) would indicate the missing moistening fluid container state.

Figure 5:
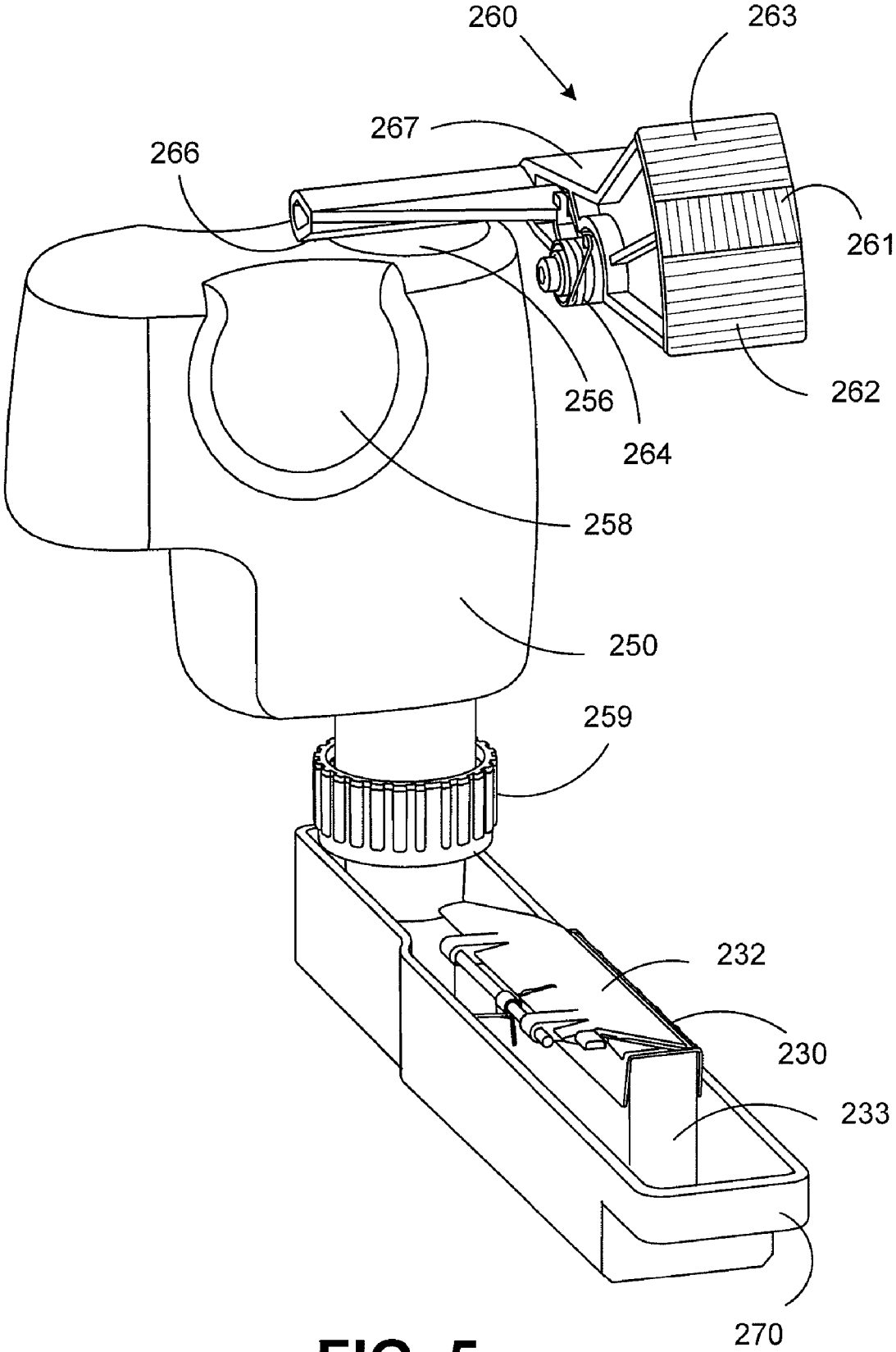
FIG. 5 is a perspective view of a moistening fluid tray, bottle and level indicator according to an illustrative embodiment of the present application.

Referring to FIG. 5, a perspective view of a moistening fluid tray 270, bottle 250 and level indicator 260 according to an illustrative embodiment of the present application is shown. The moistening tray 270 is operatively connected to a fluid wick assembly 233 that is operatively connected to a moistening fluid bristle brush assembly 230 and located near the brush holder 232. The moistening fluid container assembly includes a bottle 250 with a spring-loaded cap/valve assembly 259. The bottle 250 includes handle surface 258 that permits a finger grip. The bottle 250 also includes an indicator surface 256 that in operation will contact a cam surface 266 of fluid level indicator 260. The fluid level indicator 260 includes an arm 267 and bias assembly 264 including a spring. The fluid level indicator includes an indicator face having indicator sections 261, 262, 263.

Figure 6A:
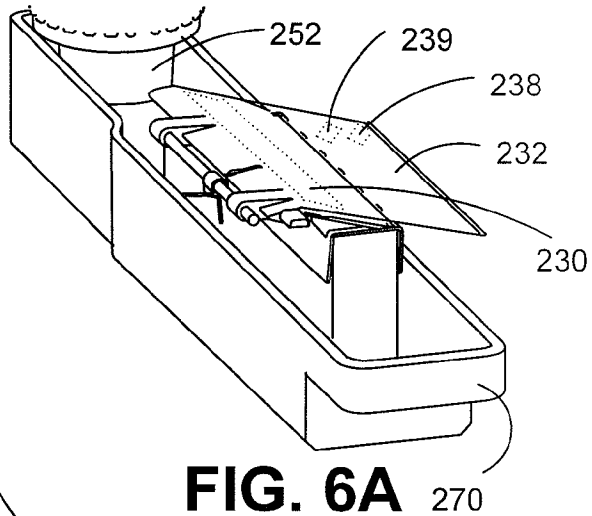
FIG. 6A is a partial side cutaway view of the moistening fluid applicator including an electrical fluid detector as shown in FIG. 6.
Figure 6:
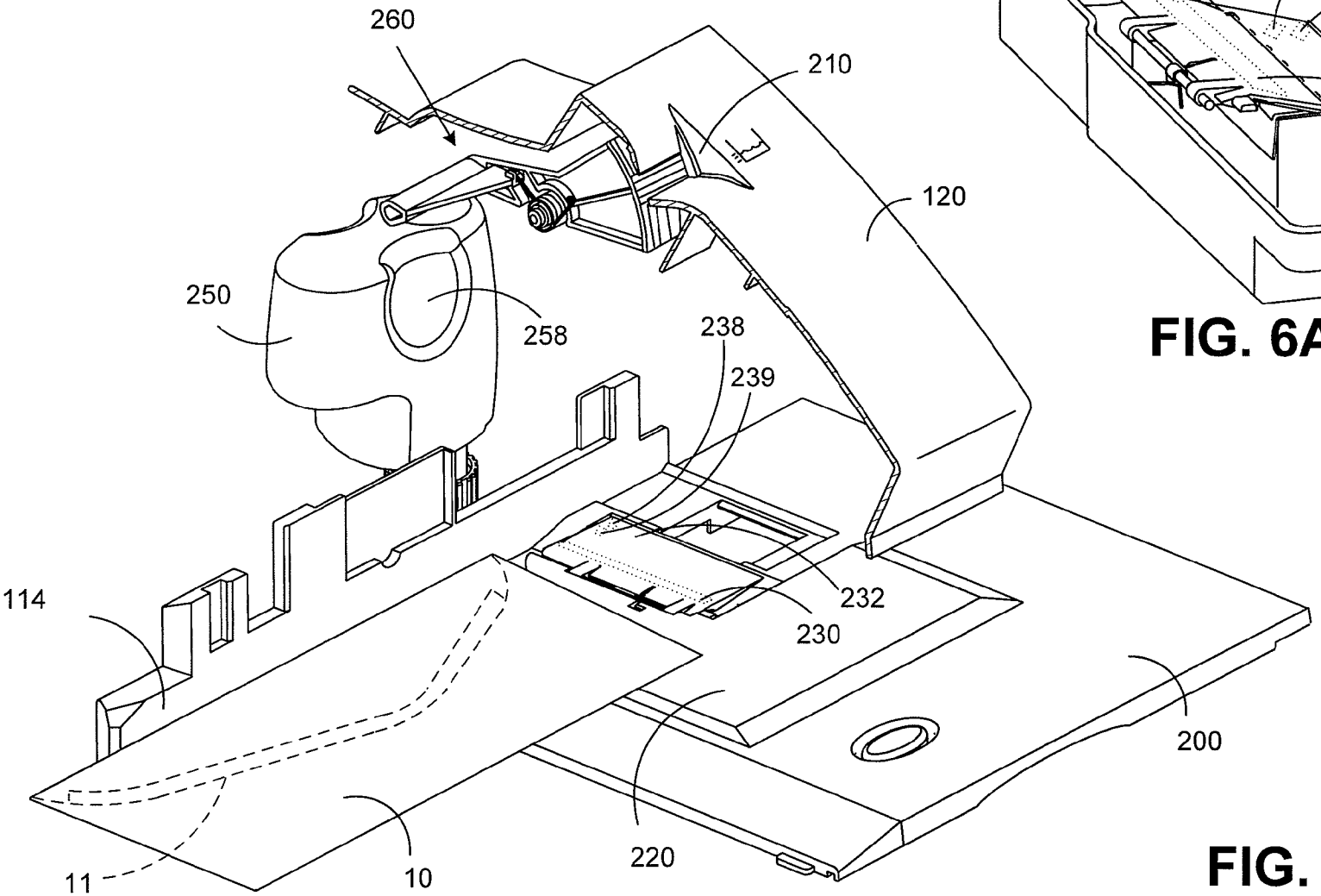
FIG. 6 is an alternative partial cutaway view along line 2-2 of FIG. 1 according to an illustrative embodiment of the present application including an electrical fluid detector.

Referring to FIG. 6, an alternative partial cutaway view along line 2-2 of FIG. 1 according to an illustrative embodiment of the present application including an electrical fluid detector is shown. In an alternative illustrative embodiment, a mailing machine is provided including an electrical moistening fluid detector. The mailing machine includes a mail piece transport including a mail piece flap opening and moistening assembly, a moistening fluid container operatively connected to the moistening assembly for providing moistening fluid to the moistening assembly, and an electrical moistening fluid detector downstream of the moistening fluid applicator for detecting presence of moistening fluid.

In this embodiment, the moistening/sealing assembly 200 includes an opener deck 220 and associated brush holder 232 and moistening brush 230. In this embodiment, the brush holder 232 is elongated in the media transport direction. The Moistening fluid container bottle 250 includes a finger grip 258 and is also operatively connected to fluid level indicator assembly 260. The top cover 120 includes an indicator window 210. The envelope 10 with flap 11 is transported adjacent to registration wall 114 along the feed deck 110 generally in a left to right direction. As the envelope passes thorough the assembly 200, it is opened and the flap is moistened. If the mail batch run does not need to be sealed, the seal/no seal lever 219 located near the indicator window 120 is activated to raise a bypass ramp in the assembly 200 so that the opening blade ramp 218 is not engaged.

Downstream of the moistening brush 230, the underside of the brush holder 232 includes two copper electrical contacts 238, 239. Each contact is electrically connected to a circuit in the main controller 130 such as by two respective copper wires (not shown). The controller 130 includes a continuity circuit that is used to test whether an electrical connection is present across the gap between contact 238 and contact 239. The continuity circuit may include a connection to VCC such as 5 volts, a current limiting resistor, the gap between 238, 239 and a connection to ground. In another example, the continuity circuit may include a sample and hold circuit including a capacitor grounded on one end that is switched to VCC when the gap 238, 239 is electrically closed.

In alternative embodiments, any known switch debounce or sample and hold circuit may be used for accurately sampling whether the gap 238, 239 is electrically closed to indicate that the moistening fluid was applied. For example, when a moistened envelope flap is transported past and against the brush holder 232, the wet glued flap provides an electrical contact between contacts 238, 239 and closes the circuit. Here, the mailing machine 100 uses a manual moistening/sealing engagement lever 219 and a sensor informs the controller 130 when to expect moistened envelopes to be transported by the electrical detector 238, 239. In a mailing machine with an automatic moistening sealing ramp control, the controller 130 would set the ramp and then test the moistening fluid detector at the appropriate time when an envelope is sealed.

Referring to FIG. 6A, a partial side cutaway view of the moistening fluid applicator including an electrical fluid detector of FIG. 6 is shown. The moistening fluid bottle 250 includes a spring loaded valve mechanism and cap 252 used to engage a plunger in the moistening fluid tray 270 that contains the dispensed fluid 22. The envelope 10 and flap 11 engage the moistening subassembly blade 220 while being transported adjacent to the registration wall 114. The dispensed fluid 22 engages moistening fluid wick 233 that feeds moistening brush bristles 230 to moisten flap 11. Even after bottle 250 is just emptied, the fluid tray 270 will contain a significant amount of dispensed fluid 22 that may be used to indicate an amount of envelope moistening capacity when the bottle empty condition is reached. Accordingly, in this embodiment, the mechanical fluid detector 260 may indicate that the moistening fluid bottle 250 is empty, but the electrical detector 238, 239 may be used to determine if there is any moistening fluid available in tray 270 by testing envelopes downstream of the moistening brush 230.

In yet another alternative embodiment, an electrical switch or optical sensor is placed in assembly 260 to electrically report to the controller 130 the fact that the moistening fluid bottle is empty. Is such an alternative, the first electrical signal from the assembly 260 may be utilized to provide an initial warning to the mailing machine operator and the second electrical signal from detector 238, 239 may be used to provide a second more critical moistening/sealing failure warning to the mailing machine operator.

In another illustrative embodiment, a mailing machine having a moistening fluid level indicator includes a mail piece transport including a mail piece flap opening and moistening assembly, a moistening fluid container operatively connected to the moistening assembly for providing moistening fluid to the moistening assembly, and a fluid level indicator arm operatively connected to the moistening fluid container, wherein the fluid level indicator arm has an indicator surface adjacent to an indicator window for indicating the presence of the moistening fluid level container and for indicating an amount of moistening fluid in the container. In an alternative, the moistening assembly includes a moistening brush connected to a moistening flap for applying moistening fluid to an envelope flap. In another alternative, the mailing machine further includes an electrical moistening fluid presence detector connected to the moistening flap downstream of the moistening brush, wherein the electrical moistening fluid presence detector is operatively connected to the mailing machine processor. In yet another alternative, the mailing machine further includes an electrical moistening fluid level detector operatively connected to the fluid level indicator arm to determine moistening fluid level, wherein the electrical moistening fluid level detector is operatively connected to the mailing machine processor. In another alternative, the user interface controller is configured to provide an indication to a mailing machine user based upon a signal received from the electrical moistening fluid presence detector. In another alternative, the user interface controller is configured to provide an indication to a mailing machine user based upon a signal received from the electrical moistening fluid level detector. In yet another alternative, the user interface controller is configured to provide a second indication to a mailing machine user based upon a signal received from the electrical moistening fluid presence detector.

Although the invention has been described with respect to particular illustrative embodiments thereof, it will be understood by those skilled in the art that the foregoing and various other changes, omissions and deviations in the form and detail thereof may be made without departing from the scope of this invention.

What is claimed is:

1. A mailing machine having a moistening fluid level indicator comprising;

a mail piece transport including a mail piece flap opening and moistening assembly, a moistening fluid container operatively connected to the moistening assembly for providing moistening fluid to the moistening assembly, and a fluid level indicator arm operatively connected to the moistening fluid container, wherein the fluid level indicator arm has an indicator surface adjacent to an indicator window for indicating the presence of the moistening fluid level container and for indicating an amount of moistening fluid in the container, and wherein, the moistening fluid container is spring biased upward operatively connected to a cam surface of the fluid level indicator arm.

2. The mailing machine according to claim 1, wherein:

the fluid level indicating arm includes an indicator surface having at least two portions, each of the two portions marked with respective different color.

3. The mailing machine according to claim 2, further comprising:

a moistening fluid level gauge marked on a surface adjacent to the fluid level indicator arm.

4. The mailing machine according to claim 3, further comprising:

a user interface controller including a mailing machine processor operatively connected to the mailing machine; and a moistening system engagement sensor operatively connected to the mail piece flap opening and moistening assembly and the mailing machine processor.

5. The mailing machine according to claim 4, wherein the moistening assembly includes a moistening brush connected to a moistening brush holder for applying moistening fluid to an envelope flap.

6. A mailing machine having a moistening fluid level indicator comprising;

a mail piece transport including a mail piece flap opening and moistening assembly, a moistening fluid container operatively connected to the moistening assembly for providing moistening fluid to the moistening assembly, and a fluid level indicator arm operatively connected to the moistening fluid container, wherein the fluid level indicator arm has an indicator surface adjacent to an indicator window for indicating the presence of the moistening fluid level container and for indicating an amount of moistening fluid in the container, wherein the moistening assembly includes a moistening brush connected to a moistening brush holder for applying moistening fluid to an envelope flap, further comprising:

an electrical moistening fluid presence detector connected to the moistening brush holder downstream of the moistening brush, wherein the electrical moistening fluid presence detector is operatively connected to the mailing machine processor.

7. The mailing machine according to claim 6, further comprising:

an electrical moistening fluid level detector operatively connected to the fluid level indicator arm to determine moistening fluid level, wherein the electrical moistening fluid level detector is operatively connected to the mailing machine processor.

8. The mailing machine according to claim 7, wherein, the user interface controller is configured to provide an indication to a mailing machine user based upon a signal received from the electrical moistening fluid level detector.

9. The mailing machine according to claim 8, wherein, the user interface controller is configured to provide a second indication to a mailing machine user based upon a signal received from the electrical moistening fluid presence detector.

10. The mailing machine according to claim 6, wherein, the user interface controller is configured to provide an indication to a mailing machine user based upon a signal received from the electrical moistening fluid presence detector.

* * * * *